US011360417B2

(12) United States Patent
Ikegami et al.

(10) Patent No.: US 11,360,417 B2
(45) Date of Patent: Jun. 14, 2022

(54) HEATER, FIXING UNIT AND IMAGE FORMING APPARATUS

(71) Applicant: Canon Kabushiki Kaisha, Tokyo (JP)

(72) Inventors: Shoichiro Ikegami, Kanagawa (JP); Tomoo Akizuki, Kanagawa (JP); Hiroki Sasame, Tokyo (JP); Yusuke Shimizu, Kanagawa (JP); Tatsuya Kinukawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/173,579

(22) Filed: Feb. 11, 2021

(65) Prior Publication Data

US 2021/0263454 A1 Aug. 26, 2021

(30) Foreign Application Priority Data

Feb. 20, 2020 (JP) ..... JP2020-026804

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
CPC ..... G03G 15/2053; G03G 15/2057; G03G 2215/2003
See application file for complete search history.

(56) References Cited

U.S. PATENT DOCUMENTS 5,355,204 A * 10/1994 Aoki ..... G03G 15/2064 399/329
2021/0157258 A1* 5/2021 Saeki ..... G03G 15/2064

FOREIGN PATENT DOCUMENTS

| | | | |
|---|---|---|---|
| JP | 09197864 | A | 7/1997 |
| JP | 2001223068 | A | 8/2001 |
| JP | 2003086333 | A | 3/2003 |
| JP | 2017062382 | A | 3/2017 |

* cited by examiner

*Primary Examiner* — Thomas S Giampaolo, II
(74) *Attorney, Agent, or Firm* — Venable LLP

(57) ABSTRACT

A heater includes a substrate formed of metal into a plate shape in which a length in a longitudinal direction thereof is greater than a length in a short direction thereof when viewed in a thickness direction thereof, an insulating layer formed of insulating material on a first surface of the substrate on a first side in the thickness direction, a heating element arranged on the insulating layer and configured to generate heat by flowing electric current therethrough, and a cover layer arranged to cover the heating element. The heater is a warped shape when receiving no external force, such that a center portion of the heater in the longitudinal direction protrudes to the first side in the thickness direction compared to both end portions of the heater in the longitudinal direction.

15 Claims, 7 Drawing Sheets

HEATER, FIXING UNIT AND IMAGE FORMING APPARATUS

BACKGROUND OF THE INVENTION

Field of the Invention

The present disclosure relates to a heater used for fixing an image by heat, a fixing unit for fixing an image on a recording material, and an image forming apparatus for forming an image on a recording material.

Description of the Related Art

An example of a fixing unit adopting a heat-fixing system that is installed in a printer or a copying machine of an electrophotographic system is equipped with a heater having a heating resistor provided on a substrate formed of ceramics or the like, a fixing film that moves while being in contact with the heater, and a pressure roller arranged to oppose to the heater with the fixing film interposed therebetween. The recording material that bears an unfixed toner image is heated while being nipped and conveyed at a nip portion, i.e., fixing nip portion, formed between the fixing film and the pressure roller, by which the toner image borne on the recording material is heated and fixed to the recording material.

A sponge rubber roller formed of a sponge rubber including an elastic layer containing a large number of fine air bubbles is often used as a pressure roller adopted in a fixing unit capable of realizing both power saving and quick start. In a fixing unit adopting a film heating system using a sponge roller, there is a drawback that wrinkles, hereinafter referred to as paper wrinkles, tend to occur in the recording material. It is considered that paper wrinkles are generated when a conveyance speed of recording material is faster at the center portion than at right and left end portions of the pressure roller in an axial direction of rotation, i.e., longitudinal direction. Japanese Patent Application Laid-Open Publication No. 2017-062382 proposes a fixing unit that aims at reducing paper wrinkles by widening a nip width at the center portion than nip widths at both end portions of the fixing nip portion in the longitudinal direction thereof.

However, according to the configuration disclosed in the above-mentioned document, a heater holder that holds the heater is formed in a protruded shape so that the center portion of the heater holder in the longitudinal direction protrudes toward the pressure roller, and therefore, a stress has occurred when the heater was deformed along the protruded shape. Since thermal stress by heating is applied to the heater in addition to the above-mentioned mechanical stress, there is fear that problems such as damaging of the substrate or pattern destruction of the heating element.

SUMMARY OF THE INVENTION

The present disclosure can provide a heater with improved durability and a fixing unit and an image forming apparatus including the same.

According to one aspect of the disclosure, a heater includes a substrate formed of metal into a plate shape in which a length in a longitudinal direction thereof is greater than a length in a short direction thereof when viewed in a thickness direction thereof, an insulating layer formed of insulating material on a first surface of the substrate on a first side in the thickness direction, a heating element arranged on the insulating layer and configured to generate heat by flowing electric current therethrough, and a cover layer arranged to cover the heating element. The heater is a warped shape when receiving no external force, such that a center portion of the heater in the longitudinal direction protrudes to the first side in the thickness direction compared to both end portions of the heater in the longitudinal direction.

Further features of the present invention will become apparent from the following description of exemplary embodiments with reference to the attached drawings.

DESCRIPTION OF THE EMBODIMENTS

Exemplary embodiments according to the present disclosure will be described with reference to the drawings.

FIRST EMBODIMENT (1) Image Forming Apparatus

Figure 1:
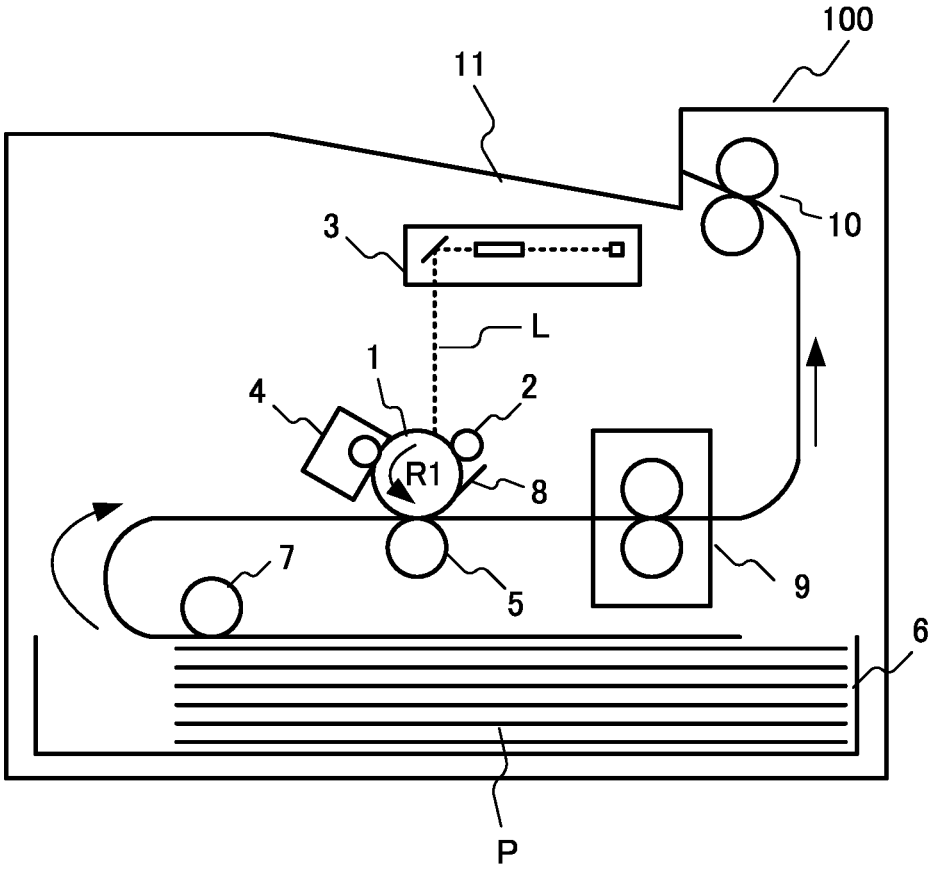
FIG. 1 is a schematic diagram illustrating an image forming apparatus according to a first embodiment.

FIG. 1 is a cross-sectional view of a laser beam printer, hereinafter simply referred to as printer 100, that adopts an electrophotographic technology and that serves as an image forming apparatus according to a first embodiment. Now, a configuration and operation of the printer 100 will be described briefly.

When a print command is received by the printer 100, a scanner unit 3 emits laser light L according to image information to a photosensitive member 1 serving as an image bearing member. The photosensitive member 1 charged to predetermined polarity by a charge roller 2 is scanned by laser light L, and an electrostatic latent image according to image information is thereby formed on a surface of the photosensitive member 1. Thereafter, toner is supplied to the photosensitive member 1 from a developing unit 4, and a toner image corresponding to the image information is formed on the photosensitive member 1. The toner image having reached a transfer portion, i.e., transfer nip portion, that has been formed between the photosensitive member 1 and a transfer roller 5 serving as a transfer unit along with the rotation of the photosensitive member 1 in the direction of arrow R1 is transferred onto a recording material P fed from a cassette 6 by a pickup roller 7. The surface of the photosensitive member 1 having passed the transfer nip portion is cleaned by a cleaner 8. The recording material P to which toner image t (FIG. 2) has been transferred is subjected to a fixing process by being heated and pressed in a fixing unit 9 of the heat-fixing system.

Thereafter, the recording material P is discharged onto a tray 11 by a sheet discharge roller 10. Various types of sheets of different sizes and materials may be used as the recording material P, such as paper including normal paper and thick paper, plastic films, cloth, coated paper and other sheet materials subjected to surface treatment, and sheets of special shapes such as envelopes and index paper. The present example is illustrated based on a system where toner image is directly transferred from the photosensitive member 1 to the recording material P, but it is also possible to apply the technique illustrated hereafter to an image forming apparatus that adopts a system where toner image formed on the photosensitive member is transferred to the recording material via an intermediate transfer member such as an intermediate transfer belt.

(2) Fixing Unit

The fixing unit 9 will now be described. The fixing unit 9 is a tensionless-type film heating system. That is, the fixing unit 9 uses a fixing film in the form of an endless belt, or a round tubular shape, having flexibility as a heat resistant film, and adopts a configuration where at least a part of the circumference of the fixing film is constantly tensionless and the fixing film rotates by rotational driving force of the pressing member.

Figure 2:
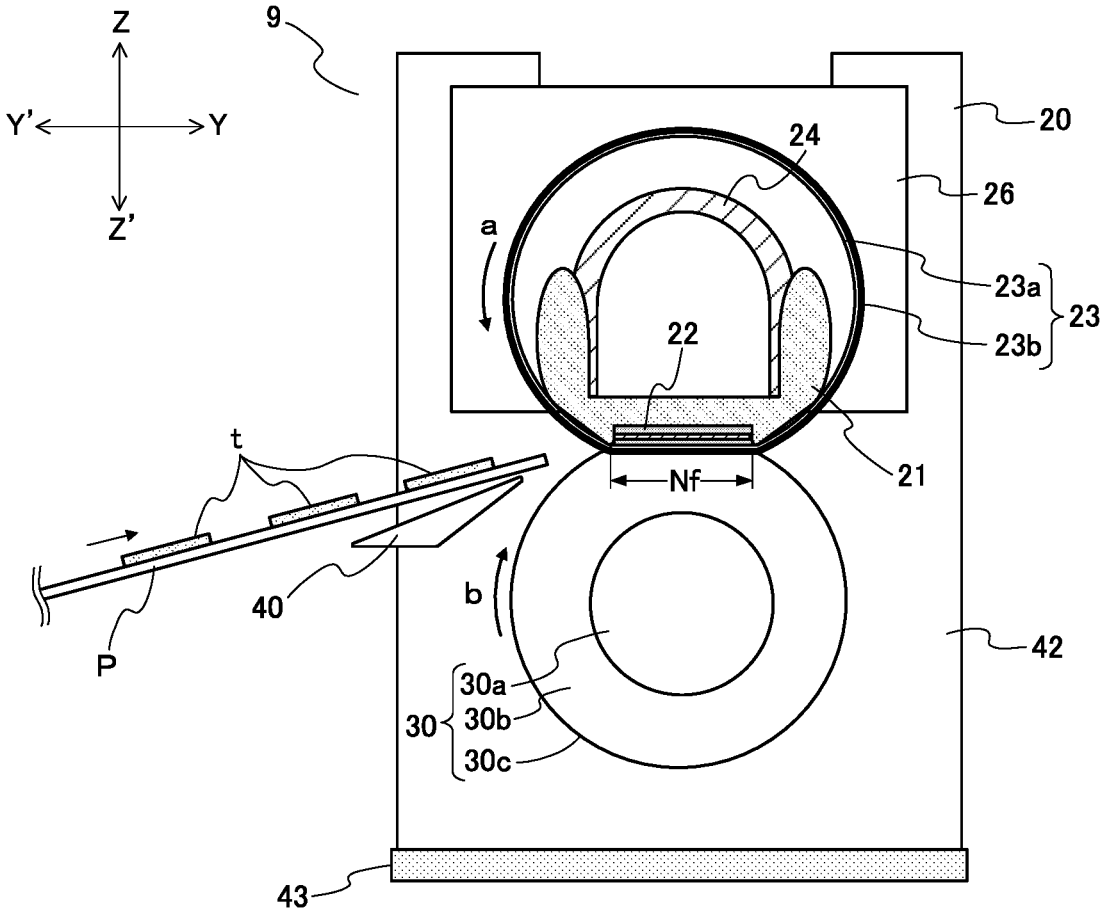
FIG. 2 is a cross-sectional view of a fixing unit according to the first embodiment.
Figure 3:
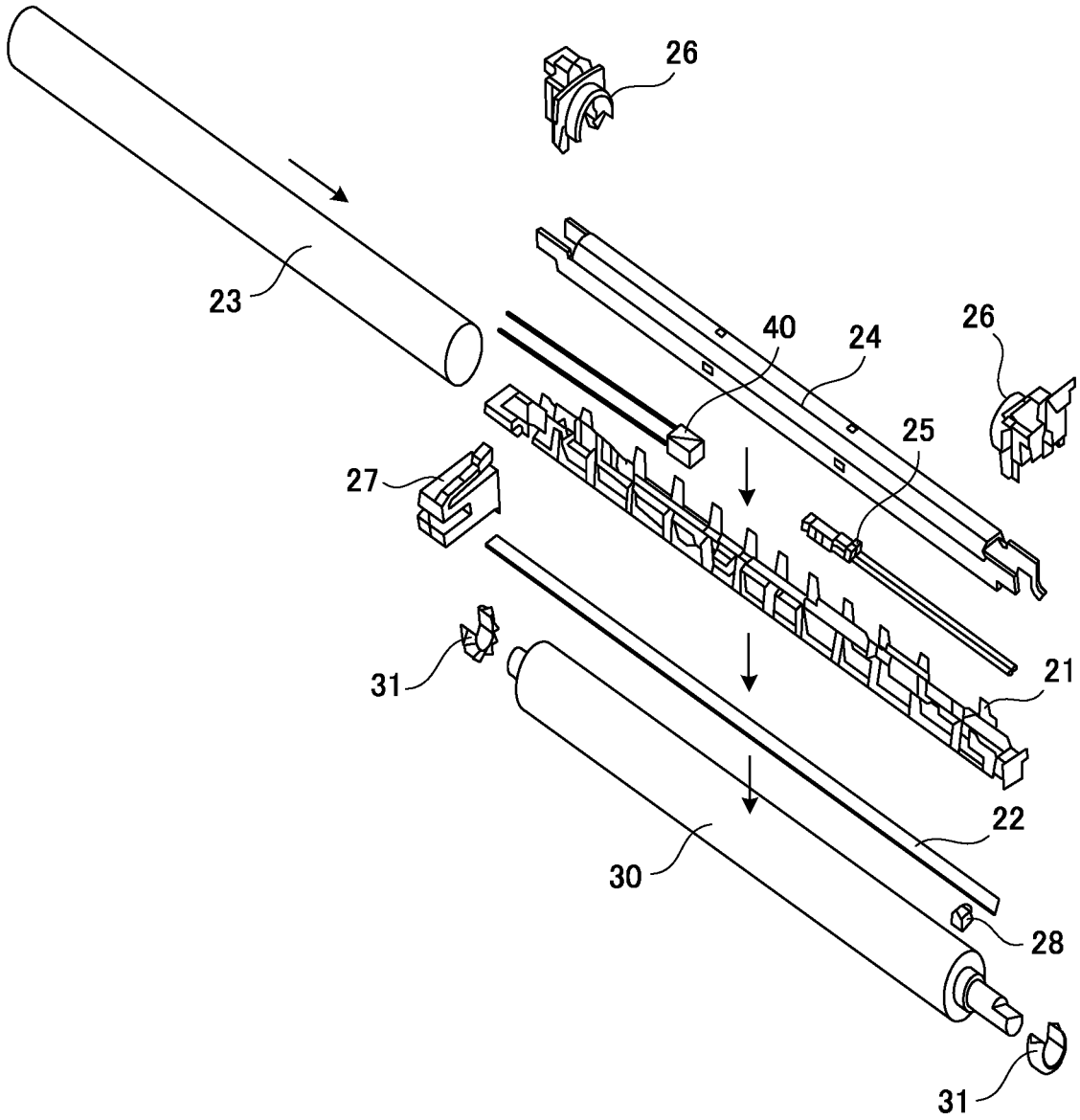
FIG. 3 is an exploded view of a film assembly used in the fixing unit according to the first embodiment.
Figure 4:
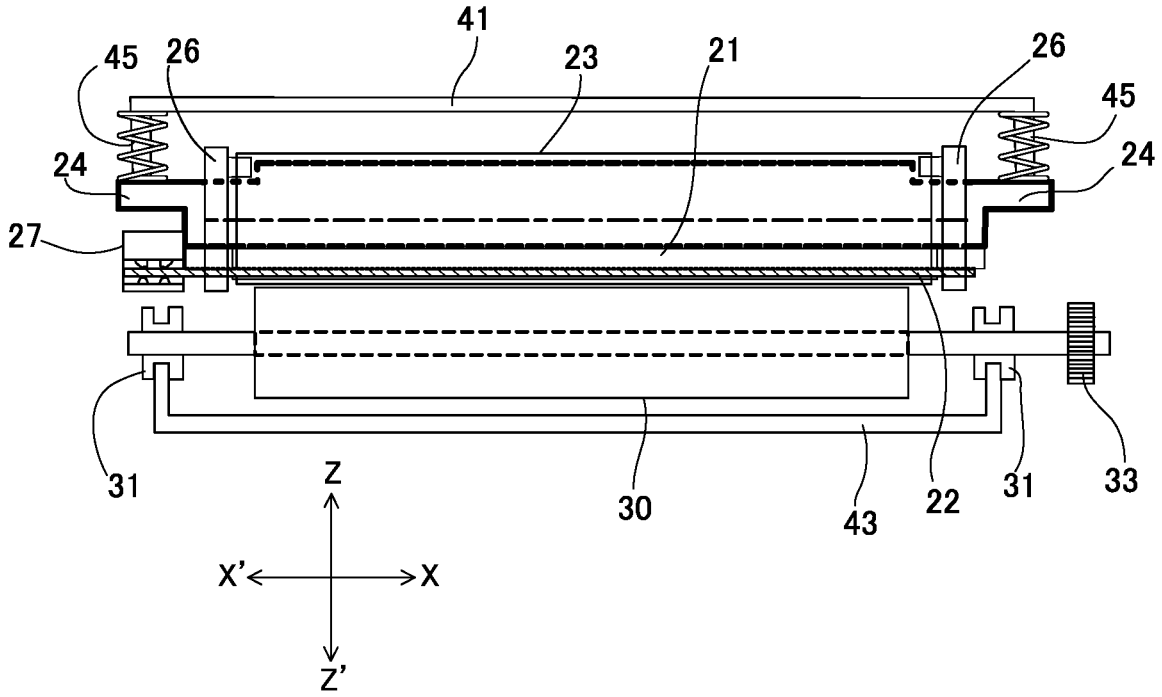
FIG. 4 is a front view illustrating a portion of the fixing unit according to the first embodiment.

Hereafter, the fixing unit 9 of the film heating system according to the present embodiment will be described in detail. FIG. 2 is a cross-sectional view of the fixing unit 9. FIG. 3 is an exploded perspective view of a film assembly 20 used in the fixing unit 9. FIG. 4 is a front view illustrating a portion of the fixing unit 9. In FIGS. 2 and 4, arrow X denotes a longitudinal direction of the fixing unit 9, arrow Z denotes upward in a vertical direction, and arrow Y denotes a direction perpendicular to the longitudinal direction and the vertical direction.

The fixing unit 9 according to the present embodiment includes, as illustrated in FIGS. 2 to 4, a fixing film 23 having a tubular shape, a heater 22 serving as a heating element and disposed inside the fixing film 23 to be in contact with an inner surface of the fixing film 23, and a pressure roller 30 serving as a pressing member that is pressed toward the heater 22 via the fixing film 23. A fixing nip portion Nf serving as a nip portion between the fixing film 23 and the pressure roller 30 is formed at a portion overlapped with an area where the heater 22 is in contact with the fixing film 23. The heater 22 is held by a heater holder 21 which serves as a holding member formed of heat-resistant resin. The heater 22 and the heater holder 21 function as a nip forming unit of the present embodiment for forming the fixing nip portion Nf The heater holder 21 also functions as a guide for guiding rotation of the fixing film 23. The pressure roller 30 receives driving force from a motor and rotates in the direction of arrow b. The fixing film 23 is driven by following the rotation of the pressure roller 30 and rotates in the direction of arrow a.

The heater holder 21 is a molded component formed of heat-resistant resin such as PPS (polyphenylene sulfide) or liquid crystal polymer. The heater 22 includes a substrate mainly composed of a pure metal or an alloy and having an elongated plate shape, i.e., metal substrate, a resistance heating element, i.e., heating element, that generates heat by electric power conduction, an insulating layer for insulating the resistance heating element and the substrate, and a glass coat layer for protecting the heating element. The details of the heater 22 will be described later.

A thermistor 25 serving as a temperature detecting element and an electric power conduction breaking element 40 are abutted against the heater 22 at an opposite side, that is, upper side in the drawing, from an abutting surface against the fixing film 23. By controlling the electric power conduction to the heating element in accordance with the detection temperature of the thermistor 25, the temperature of the fixing nip portion Nf is maintained at a set temperature suitable for fixing the image. The electric power conduction breaking element 40 has a function to physically break the electric power conduction to the heater 22 when a predetermined temperature has been reached, and it serves as a safety system against abnormal temperature rise that causes the fixing unit 9 to enter a runaway state due to an unexpected situation. In order to break the electric power conduction reliably and safely, the electric power conduction breaking element 40 must operate before the heater 22 is damaged.

The thickness of the fixing film 23 should preferably be between 20 μm and 100 μm to ensure good thermal conductivity. A single-layer film formed of a material such as PTFE (polytetrafluoroethylene), PFA (tetrafluoroethylene—perfluoro alkyl vinyl ether copolymer) or PPS is suitable as the fixing film 23. Further, a composite layer film in which a surface of a base layer 23*a* formed of a material such as PI (polyimide), PAI (polyamide imide), PEEK (polyether ether ketone) or PES (polyethersulfone) is coated with a material such as PTFE, PFA or FEP (tetrafluoroethylene—hexafluoropropylene copolymer) as a release layer 23*b*, i.e., surface layer, is also suitable as the fixing film 23. Even further, it is also suitable to use a pure metal or an alloy having high thermal conductivity as the base layer 23*a*, and to apply the aforementioned coating treatment and coating of a fluororesin tube to the release layer 23*b*. The pure metal may be Al, Ni, Cu or Zn, and the alloy may be a stainless steel or an alloy of Al, Ni, Cu and/or Zn.

According to the present embodiment, PI having a thickness of 60 μm was used as the base layer 23*a* of the fixing film 23, and coating of PFA having a thickness of 12 μm was provided as the release layer 23*b*, considering both wear of the release layer by flowing of sheets and thermal conductivity.

The pressure roller 30 serving as a pressing member, i.e., pressurizing rotary member, includes a core metal 30*a* formed of a material such as iron or aluminum, an elastic layer 30*b* formed of a material such as silicone rubber, and a release layer 30*c* formed of a material such as PFA (FIG. 2). The elastic layer 30*b* is formed on an outer circumference of the core metal 30*a*, and the release layer 30*c* is formed on an outer circumference of the elastic layer 30*b*, constituting an outermost layer of the pressure roller 30. A driving gear 33 (FIG. 4) is attached to one end portion in the axial direction of the core metal 30*a* of the pressure roller 30, and the pressure roller 30 rotates by receiving rotational driving force from a drive unit not shown via the driving gear 33.

In the present embodiment, an outer diameter of the pressure roller 30 is set to 18 mm, the core metal 30*a* is formed of iron with a diameter of 11 mm, the elastic layer 30*b* is formed of open-cell foam sponge rubber with a thickness of 3.5 mm, and the release layer 30*c*, i.e., the surface layer, is formed of PFA with a thickness of 20 μm. As for hardness, an Asker C hardness of 50° to a load of 500 g was realized.

The configuration of the fixing unit will now be described with reference to the cross-sectional view of FIG. 2. A reinforcement member 24 is formed of a metal such as iron, the member being provided to maintain strength so that the heater holder 21 will not deform greatly even when pressure is applied toward the pressure roller 30. The heater 22 is pressed toward the pressure roller 30 via the heater holder 21 and the reinforcement member 24 by a pressurizing member described later. An area where the pressure roller 30 and the fixing film 23 are in close contact with each other, i.e., pressure contact area, by the pressing force is referred to as the fixing nip portion Nf according to the present embodiment. A pressurizing position of the pressure roller 30, i.e., position of application point of pressing force of the heater 22 to the pressure roller 30, roughly corresponds to a position of a center portion of the heater 22 in a conveyance direction of the recording material.

Next, the present embodiment is described by referring to the perspective view of FIG. 3. The heater holder 21 has a gutter-like shape, i.e., U shape, in transverse section, and the reinforcement member 24 fits to an inner side of the gutter shape. A heater accommodating groove is provided on the heater holder 21 at a side opposed to the pressure roller 30, and the heater 22 is positioned at a desired position by fitting into the heater accommodating groove. The fixing film 23 is externally fit with circumferential margin to an outer side of the heater holder 21 to which the above-mentioned component has been assembled. An axial direction of the tubular shape of the fixing film 23, i.e., a direction of the arrow in which the fixing film 23 is inserted in the drawing, is referred to as a "longitudinal direction X" of the fixing unit 9. In the present embodiment, the pressure roller 30, the heater 22 and the heater holder 21 are all long and narrow members that extend in the longitudinal direction X.

Both end portions of the reinforcement member 24 in the longitudinal direction X are projected portions that protrude from both ends of the fixing film 23, having flange members 26 and 26 respectively fit thereto. The fixing film 23, the heater 22, the heater holder 21, the reinforcement member 24 and the flange members 26 and 26 are assembled together as the film assembly 20.

A power feed terminal of the heater 22 is also protruded from one side in the longitudinal direction X with respect to the fixing film 23, and a power feed connector 27 is fit to the power feed terminal. The power feed connector 27 is in contact with an electrode portion of the heater 22 with a certain contact pressure and constitutes a power supply path for supplying power fed from a commercial power supply to the heater 22.

A heater clip 28 is attached to the other side, that is, the side opposite to the power feed terminal, of the heater 22 in the longitudinal direction X. The heater clip 28 is a metal plate that is bent in a U shape and has a spring property that enables the end portion of the heater 22 to be held on the heater holder 21.

Next, the present embodiment is described with reference to the front view of FIG. 4. The respective flange members 26 and 26 regulate movement in the longitudinal direction X of the fixing film 23 being driven to rotate, and thereby regulate the position of the fixing film 23 during operation of the fixing unit. A distance between flanges of the flange members 26 and 26, that is, parts coming into sliding contact with end portions of the fixing film, on both ends in the longitudinal direction X is set longer than the length of the fixing film 23 in the longitudinal direction X. This arrangement enables to prevent the end portions of the fixing film from being damaged during normal state of use.

Further, the length of the pressure roller 30 in the longitudinal direction X is set approximately 10 mm shorter than the fixing film 23. This arrangement is adopted to prevent grease from leaking from ends of the fixing film 23 and adhering to the pressure roller 30, causing the pressure roller 30 to lose its gripping force on the recording material and slip.

The film assembly 20 is arranged to oppose to the pressure roller 30 and supported on a top-side casing 41 of the fixing unit 9 in a state where movement in the longitudinal direction X, i.e., right-left directions in the drawing, is restricted and movement in the vertical direction is enabled. A pressurizing spring 45 serving as a pressurizing member is attached in a compressed manner to the top-side casing 41. The pressing force of the pressurizing spring 45 is received by the projected portion of the reinforcement member 24, and by having the reinforcement member 24 press against the pressure roller 30, the whole film assembly 20 is pressed against the pressure roller 30.

A bearing member 31 is provided to bear the core metal of the pressure roller 30 (refer also to FIG. 3). The bearing member 31 receives pressing force from the film assembly 20 via the pressure roller 30. In order to rotatably support the core metal of the pressure roller 30 that is heated to a relatively high temperature, the material of the bearing preferably has sufficient heat resistance and superior sliding property. The bearing member 31 is attached to a bottom-side casing 43 of the fixing unit.

The bottom-side casing 43 and the top-side casing 41 constitute a casing, i.e., frame member, of the fixing unit 9 together with frame side panels 42 and 42 that are provided on both sides in the longitudinal direction X of the film assembly 20 and extend upward and downward.

(3) Heater

Next, materials constituting the heater 22 according to the present embodiment and a method for manufacturing the same will be described with reference to FIGS. 5A to 5C.

Figure 5A:
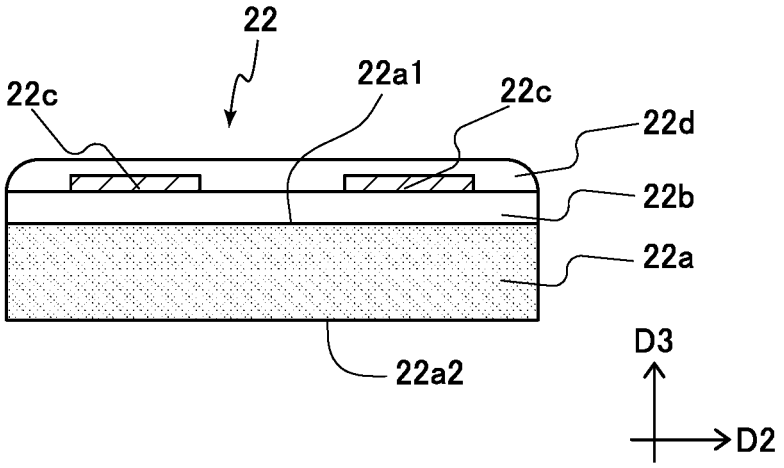
FIG. 5A is a cross-sectional view of a heater according to the first embodiment.

FIG. 5A is a cross-sectional view of the heater 22. The heater 22 includes a substrate 22*a* formed of metal, a heating element 22*c* serving as a heating resistance layer that generates heat by electric power conduction, an insulating layer 22*b* that insulates the heating element 22*c* and the substrate 22*a*, and a cover layer 22*d* such as a glass coating layer that protects the heating element. The substrate 22*a* is an elongated plate shape member formed mainly of a pure metal or an alloy. That is, the substrate 22*a* is a metal plate whose length in a longitudinal direction D1 in a state where it is assembled to the fixing unit is greater than a length thereof in a short direction D2, that is, conveyance direction of the recording material in the fixing nip portion Nf. The longitudinal direction D1, the short direction D2 and a thickness direction D3 of the substrate 22*a* of heater 22 are perpendicular to one another.

Materials such as stainless steel, nickel, copper or aluminum, or an alloy mainly composed of these metals are suitably used as the material for the substrate 22*a*. Among these materials, stainless steel is most preferable from the viewpoint of strength, heat resistance and corrosion. The type of stainless steel is not specifically limited, and any type can be selected as required considering necessary mechanical strength, linear expansion coefficient corresponding to the shape of the insulating layer and the heating element described in the next section, availability of the plate material in the market, and so on.

As an example, a martensitic- or ferritic-type chromium-containing stainless steel has a relatively low linear expansion coefficient among stainless steels and easily applied to forming an insulating layer and a heating element, so that it is suitable.

The thickness of the substrate 22*a* can be determined considering strength, heat capacity and radiation performance. A thin substrate 22*a* is advantageous for realizing a quick-start performance, that is, short time from starting of electric power conduction to reaching a target temperature of the heater 22, since it has a small heat capacity, but if it is too thin, a problem such as distortion of the substrate during sintering (firing) treatment of the heating resistor tends to occur. In contrast, a thick substrate 22*a* is advantageous from the viewpoint of preventing distortion of the heating resistor during thermoforming, but excessive thickness increases the heat capacity and is disadvantageous in realizing a quick start. Preferable thickness of the substrate 22*a*, considering the balance of mass productivity, cost and performance, is between 0.3 mm and 2.0 mm.

The material of the insulating layer 22*b* is not specifically limited, but it is necessary to select an insulating material having heat resistance in view of the actual temperature during use. The material of the insulating layer 22*b* is preferably glass or PI (polyimide) from the viewpoint of heat resistance, and in the case of glass, the actual powder material to be used should be selected within a range not deteriorating the characteristics of the present embodiment. A heat-conductive filler having an insulating property may be mixed as needed. There is no problem in using the same material or different materials for the insulating layer 22*b*. Similarly, the thickness may be the same within the insulating layer 22*b* or varied as needed.

In general, the heater 22 to be used in the image forming apparatus should preferably have a dielectric voltage of approximately 1.5 kV. Therefore, the thickness of the insulating layer 22*b* should be determined according to the material to realize a dielectric voltage performance of 1.5 kV between the heating element 22*c* and the substrate 22*a*.

The method for forming the insulating layer 22*b* is not specifically limited, but as an example, the insulating layer 22*b* can be formed smoothly by adopting screen printing. When forming an insulating layer of glass or PI (polyimide) on the substrate 22*a*, it is necessary to adjust the linear expansion coefficients of the substrate and the insulating layer material as required so that cracking and peeling do not occur in the insulating layer by the difference between linear expansion coefficients of the materials.

The heating element 22*c* is formed by printing a heating resistor paste having mixed (A) conductive component, (B) glass component and (C) organic binder component onto the insulating layer 22*b*, and then sintering the paste. When the heating resistor paste is sintered, the (C) organic binder component is burnt out and only components (A) and (B) are left, so that the heating element 22*c* containing the conductive component and the glass component is formed.

In the embodiment, materials such as silver-palladium (Ag—Pd) and ruthenium oxide ($RuO_2$) are used alone or in combination as the conductive component (A), and a sheet resistance of 0.1 [Ω/□] to 100 [KΩ/□] is suitable. Materials other than those mentioned above in (A) to (C) can also be contained as long as the amount is subtle enough so as not to deteriorate the characteristics of the present embodiment.

Figure 5B:
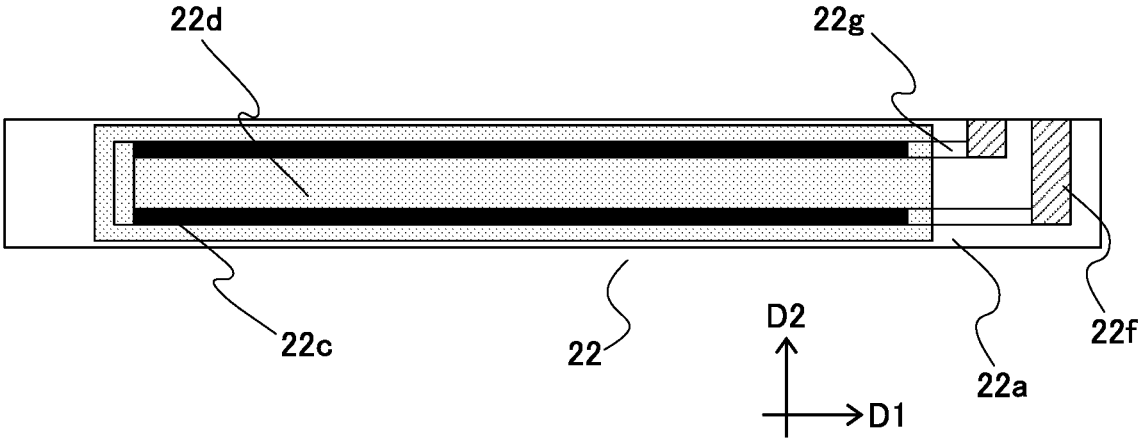
FIG. 5B is a top view of the heater according to the first embodiment.
Figure 5C:
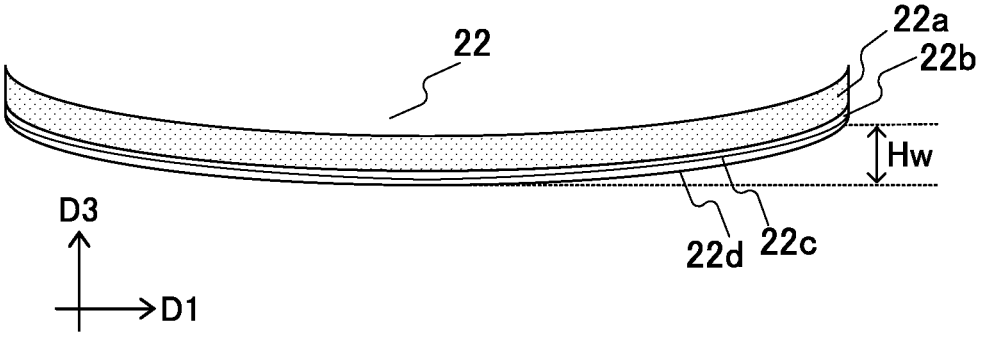
FIG. 5C is a cross-sectional view of the heater according to the first embodiment.

A power supplying electrode 22*f* and a conductive pattern 22*g* illustrated in FIG. 5B are mainly composed of a conductive component such as silver (Ag), platinum (Pt), gold (Au), silver-platinum (Ag—Pt) alloy or silver-palladium (Ag—Pd) alloy. The power supplying electrode 22*f* and the conductive pattern 22*g* are formed, similar to the heat resistor paste, by printing a paste having mixed (A) conductive component, (B) glass component and (C) organic binder component to the insulating layer 22*b*, and then sintering the same. The power supplying electrode 22*f* and the conductive pattern 22*g* are conductive parts that are provided to feed power to the heating element 22*c*, and the resistance is set sufficiently low compared to the heating element 22*c*.

Note that, it is necessary to select a material that softens and melts at a temperature lower than a melting point of the substrate 22*a* and a material that has sufficient heat resistance in consideration of the temperature during actual use as the aforementioned heating resistor paste and the paste for forming the power supplying electrode and conductive pattern.

As illustrated in FIG. 5A, the cover layer 22*d* that covers the heating element 22*c* and the conductive pattern 22*g* are provided on the insulating layer 22*b* of the heater 22. In a case where the heating element 22*c* is arranged at a side of the substrate 22*a* that contacts the fixing film 23, that is, lower side of FIG. 2, the cover layer 22*d* exerts a protective function of ensuring an electrical insulating property between the heating element 22*c* and the fixing film 23 and ensuring a sliding property between the heating element 22*c* and the fixing film 23. The material of the cover layer 22*d* should preferably be glass or PI (polyimide) from the viewpoint of heat resistance, and a heat-conductive filler having an insulating property may be mixed thereto as needed.

In the present embodiment, a ferritic stainless-steel substrate (18 Cr stainless-steel, linear expansion coefficient $11.0\times10^{-5}$/° C.) having a width, that is, dimension in the short direction D2, of 6 mm, a length, that is, dimension in the longitudinal direction D1, of 300 mm, and a thickness, that is, dimension in the thickness direction D3, of 0.5 mm was prepared as the substrate 22*a*.

Next, the glass paste for forming the insulating layer was applied on the aforementioned stainless-steel substrate by screen printing, and then dried at 180° C. and sintered at 850° C. to form the insulating layer 22*b*. The thickness of the insulating layer 22*b* after sintering was 60 μm.

Thereafter, a heating resistor paste and a paste for forming a power supply electrode and a conductive pattern were prepared. The heating resistor paste contains silver-palladium (Ag—Pd) as the conductive component, with a glass component and an organic binder component mixed thereto. The paste for forming the power supply electrode and the conductive pattern contains silver as the conductive component, with a glass component and an organic binder component mixed thereto. The respective pastes were applied to the stainless-steel substrate by screen printing, and then dried at 180° C. and sintered at 850° C. to form the heating element 22*c*, the power supplying electrode 22*f* and the conductive pattern 22*g*. After sintering, the thickness of the heating element 22*c* was 15 μm, the length was 220 mm and the width was 1 mm.

Next, the glass paste for the cover layer was prepared, and the glass paste for the cover layer was applied on the heating element 22*c* and the conductive pattern 22*g* by screen printing, and then dried at 180° C. and sintered at 850° C. to form the cover layer 22*d*. The thickness of the cover layer 22*d* after sintering will be described later. The same glass material was used for the insulating layer 22*b* and the cover layer 22*d*, and the linear expansion coefficient was a value (e.g., $0.85\times10^{-6}$/° C.) smaller than the linear expansion coefficient of the substrate 22*a*.

In the present embodiment, a configuration was adopted where the thickness of the insulating layer 22*b* which is a surface 22*a*1 (i.e., first surface) of the substrate 22*a* on a side (i.e., first side) on which the heating element 22*c* is provided was set to 60 μm, and the thickness of the cover layer 22*d* was set to 60 μm, with no insulating layer provided on a surface 22*a*2 (i.e., second surface) on another side (i.e., second side) which is opposite to the first side having the heating element 22*c*. In other words, a configuration was adopted where the surface 22*a*2 of the substrate 22*a* is not covered by an insulating material when the heater 22 is viewed from the opposite side as the heating element 22*c* in the thickness direction D3, and the surface 22*a*2 is substantially exposed. According to the present embodiment, as shown in FIG. 5C, warping of the heater 22 is caused intentionally during sintering of the heater, utilizing the occurrence of residual stress under normal temperature by combining and sintering members having different thermal expansion coefficients. In the present embodiment, the thickness of the insulating layer 22*b* and the cover layer 22*d* were adjusted so that the amount of warping (Hw) of the heater caused by sintering is 500 μm.

The amount of warping (Hw) of the heater 22 is defined as a height of a highest part of the heater 22 from a surface plate in a state where the heater 22 is arranged on the horizontal surface plate (i.e., reference plane) with the heating element 22*c* arranged as the upper side. A preferable range of the amount of warping (Hw) of the heater 22 from the viewpoint of reduction of paper wrinkles and durability will be described later, but the upper limit of the amount of warping (Hw) may be determined considering the assembling property for assembling to the heater holder 21. For example, it is suitable to set the amount of warping (Hw) to 15 mm (15000 μm) or less.

(4) Generation Mechanism of Paper Wrinkles

Paper wrinkles may be generated to the recording material in the fixing unit of a heat-fixing system that adopts a configuration of nipping and conveying the recording material. Paper wrinkles may be caused by the difference in conveyance speed according to positions in a rotational axis direction, i.e., longitudinal direction, of the fixing unit. If the conveyance speed of the recording material at the center portion of the fixing nip portion in the longitudinal direction is faster than the conveyance speed of the recording material at both end portions, a force that pulls the sheet toward the center portion acts on the recording material at the area prior to, that is, upstream in the conveyance direction of, the fixing nip portion. In this state, waving tends to occur to the recording material, especially if the recording material is a thin paper having a small grammage and small stiffness. When the recording material is conveyed further and a leading edge of the waving portion is nipped, if the recording material has a high stiffness, sliding of the recording material occurs and the recording material is aligned on the nip surface so that paper wrinkles are not generated, but if the recording material has a small stiffness, the recording material will easily yield and paper wrinkles are generated.

In order to prevent the occurrence of paper wrinkles, a configuration opposite to that described above is preferable. According to a configuration where the conveyance speed of the recording material at both end portions of the fixing nip portion in the longitudinal direction is faster than the conveyance speed of the recording material at the center portion thereof, paper wrinkles are less likely to occur. This is because a force that pulls the recording material toward the right and left end portions acts on the recording material, suppressing the occurrence of waving that causes paper wrinkles at the area prior to the fixing nip portion.

(5) Deformation of Crown Shape of Heater

In the fixing unit of the film heating system using the pressure roller 30 formed of an open-cell foam sponge rubber, there is a negative correlation between the nip width and the conveyance speed of the recording material. In order to set the conveyance speed of the recording material to be slower at the center portion in the longitudinal direction D1 than at both end portions thereof, the nip width is set to be greater at the center portion than at both end portions thereof. The difference of nip widths can be realized by setting the amount of squeezing of the pressure roller 30 at the center portion of the fixing nip portion to be greater than at both end portions thereof, and the difference of amounts of squeezing of the pressure roller 30 can be realized by applying a crown shape (or, warped shape) to the heater 22.

Figure 6A:
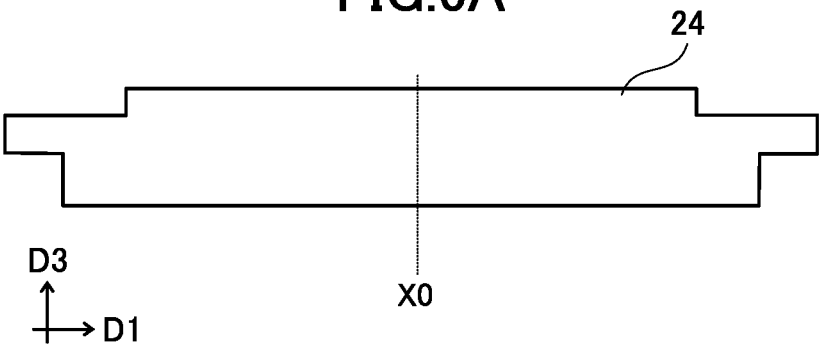
FIG. 6A is a cross-sectional view of a reinforcement member as viewed in a short direction according to the first embodiment.
Figure 6B:
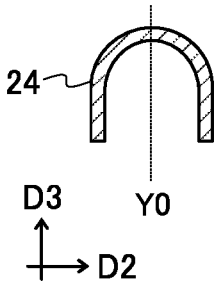
FIG. 6B is a cross-sectional view of the reinforcement member as viewed in a longitudinal direction according to the first embodiment.
Figure 6C:
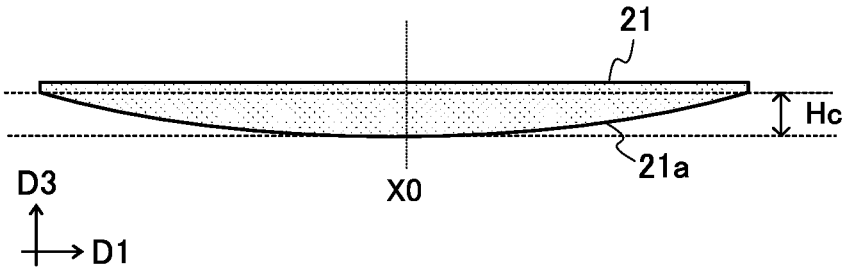
FIG. 6C is a cross-sectional view of a heater holder as viewed in the short direction according to the first embodiment.
Figure 6D:
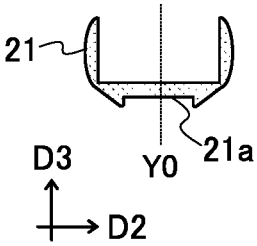
FIG. 6D is a cross-sectional view of the heater holder as viewed in the longitudinal direction according to the first embodiment.
Figure 6E:
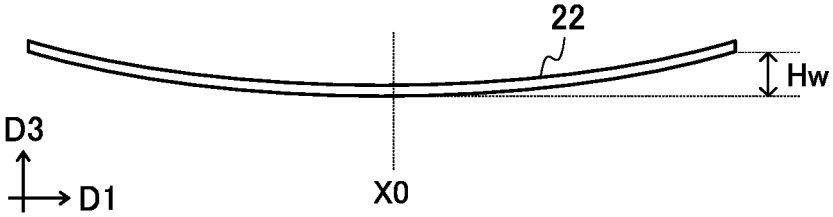
FIG. 6E is a cross-sectional view of the heater as viewed in the short direction according to the first embodiment.
Figure 6F:
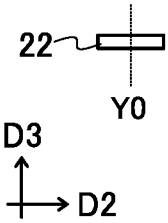
FIG. 6F is a cross-sectional view of the heater as viewed in the longitudinal direction according to the first embodiment.
Figure 6G:
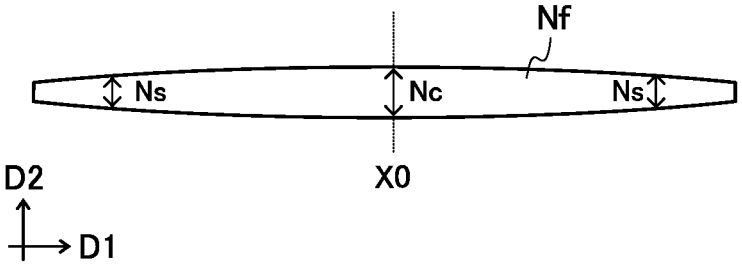
FIG. 6G is a schematic view of a fixing nip portion according to the first embodiment.

FIGS. 6A to 6G shows configuration related to the difference of nip widths of the fixing nip portion in the present embodiment. FIG. 6A is a cross-sectional view of the reinforcement member 24 as viewed in the short direction D2. FIG. 6B is a cross-sectional view of the reinforcement member 24 as viewed in the longitudinal direction D1. FIG. 6C is a cross-sectional view of the heater holder 21 as viewed in the short direction D2. FIG. 6D is a cross-sectional view of the heater holder 21 as viewed in the longitudinal direction D1. FIG. 6E is a cross-sectional view of the heater 22 as viewed in the short direction D2. FIG. 6F is a cross-sectional view of the heater 22 as viewed in the longitudinal direction D1. FIG. 6G is a schematic view of the fixing nip portion Nf as viewed in the thickness direction D3. In FIGS. 6A to 6G, X0 refers to a center position of the heater 22 (also a center of fixing nip portion Nf) in the longitudinal direction, and Y0 refers to a center position of the heater 22 in the short direction.

The crown shape (warped shape) of the heater 22 refers to a shape where the center portion of the heater 22 in the longitudinal direction D1 is protruded to one side, that is, the side having the heating element 22*c*, in the thickness direction D3 of the substrate 22*a* compared to both end portion in the longitudinal direction D1, as shown in FIG. 6E. In the present embodiment, the one side in the thickness direction D3 refers to the same side as the pressure roller 30, i.e., pressing member side, in the pressing direction of the pressure roller 30 in the state after the heater 22 has been assembled to the fixing unit.

The heater 22 is fit to the heater holder 21 and the heater holder 21 is supported by the reinforcement member 24 (FIGS. 6A and 6B). In order to provide a crown shape to the heater 22, either one of or both the heater holder 21 and the reinforcement member 24 should be provided with a crown shape. In the present embodiment, a bearing surface 21*a* (FIGS. 6C and 6D), that is, a surface supporting the surface of the heater 22 on a side opposite to the side having the heating element 22*c*, of the heater holder 21 is applied with the crown shape, so that the heater 22 takes a crown shape when pressed, and a desired nip width and conveyance speed distribution of the recording material is realized. That is, as shown in FIG. 6G, the nip width (Nc) of the fixing nip portion Nf at the center portion in the longitudinal direction D1 is greater than the nip widths (Ns) at both end portions thereof.

The crown shape of the heater holder 21 refers to a shape where, regarding the bearing surface 21*a* of the heater holder 21 supporting the heater 22, a center portion of the bearing surface 21*a* in the longitudinal direction D1 is protruded toward the pressure roller 30 with respect to the pressing direction of the pressure roller 30 compared to both end portions thereof in the longitudinal direction D1. Further, an amount of crowning (Hc) of the heater holder 21 refers to an amount of protrusion of the center portion of the bearing surface 21*a* in the longitudinal direction D1 being protruded toward the pressure roller 30 compared to both end portions thereof in the longitudinal direction D1.

According to the configuration of the present embodiment, the heater 22 is assembled to the heater holder 21, and in a state where the film assembly 20 is pressed by a pressurizing spring 45, the heater 22 is set to be aligned with the crown shape of the heater holder 21. For example, if the amount of crowning (Hc) of the heater holder 21 is 800 μm and the amount of warping (Hw) of the heater 22 is 500 μm, the heater 22 will be further warped from 500 μm to 800 μm when being pressed by the pressurizing spring 45. In other words, the amount of warping (Hw) of the heater 22 in a state where pressing of the fixing nip portion is performed approximately corresponds to the amount of crowning (Hc) of the heater holder 21 according to the present embodiment. Therefore, stress generated in the heater 22 becomes higher as the difference between the amount of warping (Hw) of the heater 22 and the amount of crowning (Hc) of the heater holder 21 increases.

(6) Effects

According to the configuration of the present embodiment, warping in the same direction as the crown surface of the heater holder 21 is given in the heater 22. In other words, the heater 22 according to the present embodiment is a prestressed member to which prestress is applied in advance that cancels out the change of stress that occurs by the pressing force of the pressure roller 30 when the heater 22 is assembled to the fixing unit. Thereby, even in a case where an amount of crowning (Hc) greater than the conventional case is applied to the heater holder 21, the stress generated in the heater 22 can be reduced, and the durability of the heater 22 can be improved. Thereby, even if the recording material P is a thin paper having a low grammage and stiffness, the electric power conduction breaking element 40 can operate safely before the heater 22 is damaged, and the present embodiment enables to realize a high paper wrinkle suppressing effect and a high margin against heater damage in the case of abnormal temperature rise.

Advantages of the present embodiment will be described in comparison with a comparative example. At first, as a configuration of a comparative example, a fixing unit of a film heating system in which the amount of warping (Hw) of the heater 22 is 0 μm was prepared. The substrate 22*a* had a width of 6 mm, a thickness of 0.5 mm and a length of 300 mm, and in a non-pressurized state, the amount of crowning (Hc) of the heater holder 21 was set to 0 μm in Configuration 1 of the comparative example, 300 μm in Configuration 2 of the comparative example, 500 μm in Configuration 3 of the comparative example, and 800 μm in Configuration 4 of the comparative example. In the present embodiment, the heater 22 with the amount of warping (Hw) set to 500 μm was prepared, and in the non-pressurized state, the amount of crowning (Hc) of the heater holder 21 was 500 μm in Configuration 1 and 800 μm in Configuration 2. Further, according to Configuration 3, the amount of warping (Hw) of the heater 22 was set to 800 μm, and the amount of crowning (Hc) applied to the heater in the non-pressurized state was set to 800 μm.

For each configuration, a nip width, a conveyance speed of recording material at a position corresponding to the nip width, an evaluation of occurrence of paper wrinkles, an evaluation of breaking of abnormal temperature rise, and image evaluation were performed. The nip width was measured by flowing a recording material to which solid black image has been printed with a rear surface facing up (i.e., a front surface with the solid black image facing the fixing film 23 and the rear surface without image facing the pressure roller 30) and stopping conveyance forcibly at a timing at which the recording material was nipped by the nip portion, so that the nip portion is thermally transferred to the solid black image portion as a trace of an area that was in contact with the pressure roller. The difference of nip widths was the difference between the nip width at the center portion in the longitudinal direction and the nip width at both end portions in the longitudinal direction.

The conveyance speed of the recording material at the position corresponding to the nip width was measured using a recording material (Canon Red Label Superior FSC 80 g/m$^2$ A4 paper) cut in a strip form with a width of 30 mm. That is, strips of the recording material were passed at the center portion and the right and left end portions of the fixing unit in the longitudinal direction, and the conveyance speed was measured. The conveyance speed of the strips of the recording material was measured downstream of the fixing nip using a digital laser doppler velocimeter (Canon Inc.). The difference between the conveyance speed of a strip of the recording material at the center portion in the longitudinal direction and strips of the conveyance speed of the recording material at both end portions in the longitudinal direction were calculated.

The evaluation of occurrence of paper wrinkles was carried out by examining the presence of paper wrinkles by varying the grammage of paper and flowing the paper through in a state where the fixability is made uniform in the respective configurations. The tests were performed under a high temperature—high humidity environment with a room temperature of 33° C. and a humidity of 80%. Paper wrinkles tend to occur in a paper having a low grammage and low stiffness, so that evaluation was performed by varying the grammage under a high temperature—high humidity environment where the stiffness becomes low.

The evaluation of breaking of abnormal temperature rise is an evaluation performed by inducing abnormal temperature rise assuming the occurrence of a double failure by supplying maximum power while anticipating tolerance from an external power supply to the heater in a rotation-stopped state and comparing the time at which the heater 22 is damaged with the time at which the electric power conduction breaking element 40 is operated. According to product structure, the electric power conduction to the heater 22 is interrupted, that is, heating of the heater is stopped, when the electric power conduction breaking element 40 operates, but in the present evaluation, the circuit was isolated in advance for evaluation, so that electric power conduction could be performed until both the heater 22 and the electric power conduction breaking element 40 are damaged. Regarding the above-mentioned evaluation result, in a state where the heater 22 was damaged earlier than the operation of the electric power conduction breaking element 40, or in a state where the heater 22 was damaged within one second after the operation of the electric power conduction breaking element 40, it was determined that there is no margin and the evaluation result was "poor". Further, if the heater 22 was damaged within one to three seconds from the operation of the electric power conduction breaking element 40, it was determined that there was little margin and the evaluation result was "average", and if the heater 22 was damaged after three seconds, it was determined that there was appropriate margin and the evaluation result was "good".

heater holder 21 is as high as 800 μm and the stress that occurs in the heater 22 is higher than Configuration 1 of the first embodiment, the occurrence of paper wrinkles was not confirmed even in a case where a recording material P having a grammage of 52 g/m$^2$ was used.

According to Configuration 3 of the present embodiment, the amount of warping (Hw) of the heater 22 is as high as 800 μm and the amount of crowning (Hc) of the heater holder 21 is also as high as 800 μm. Therefore, the stress that occurs to the heater 22 can be set to approximately the same level as Configuration 1 of the first embodiment, and no occurrence of paper wrinkles was confirmed even in a case where a recording material P having a grammage of 52 g/m$^2$ was used. As described, good results were achieved for both paper wrinkles and the durability of the heater in a case

TABLE 1

| | | | COMPARATIVE EXAMPLE | | | | FIRST EMBODIMENT | | |
|---|---|---|---|---|---|---|---|---|---|
| | | | CONFIGURATION 1 | CONFIGURATION 2 | CONFIGURATION 3 | CONFIGURATION 4 | CONFIGURATION 1 | CONFIGURATION 2 | CONFIGURATION 3 |
| AMOUNT OF WARPING OF HEATER 22 (μm) | | | 0 | 0 | 0 | 0 | 500 | 500 | 800 |
| AMOUNT OF CROWNING OF HEATER HOLDER 21 (μm) | | | 0 | 300 | 500 | 800 | 500 | 800 | 800 |
| NIP WIDTH DIFFERENCE (mm) | | | 0.0 | 0.2 | 0.4 | 0.7 | 0.4 | 0.7 | 0.7 |
| CONVEYANCE SPEED DIFFERENCE OF RECORDING MATERIAL (mm/sec) | | | 0.0 | 0.8 | 1.9 | 3.2 | 1.9 | 3.2 | 3.2 |
| EVALUATION OF OCCURRENCE OF PAPER WRINKLES | PAPER GRAMMAGE (g/m^2) | 80 | GOOD | GOOD | GOOD | GOOD | GOOD | GOOD | GOOD |
| | | 75 | GOOD | GOOD | GOOD | GOOD | GOOD | GOOD | GOOD |
| | | 64 | POOR | GOOD | GOOD | GOOD | GOOD | GOOD | GOOD |
| | | 52 | POOR | POOR | GOOD | GOOD | GOOD | GOOD | GOOD |
| EVALUATION OF BREAKING OF ABNORMAL TEMPERATURE RISE | | | GOOD | GOOD | POOR | POOR | GOOD | GOOD | GOOD |

Table 1 illustrates the results of the evaluation of occurrence of paper wrinkles and the evaluation of breaking of abnormal temperature rise according to the configuration of the comparative example and the configuration of the present embodiment. It can be recognized based on the results of Configurations 1 to 4 of the comparative example that, according to the configuration where the amount of warping (Hw) of the heater 22 is 0 mm, the paper wrinkles are improved but the evaluation of breaking of abnormal temperature rise is deteriorated in a state where the amount of crowning (Hc) of the heater 22 is increased. Especially, if a recording material P having a grammage of 52 g/m$^2$ or less is used, it has been confirmed that there is no area where the evaluation of occurrence of paper wrinkles and the evaluation of breaking of abnormal temperature rise are compatible. Focusing on the performance to prevent paper wrinkles, the amount of crowning (Hc) of the heater holder, that is, the amount of warping (Hw) of the heater 22 during use, of the heater holder 21 is preferably 300 μm or greater, more preferably 500 μm or greater, and even more preferably 800 μm or greater.

According to Configuration 1 of the present embodiment, since the amount of warping (Hw) of the heater 22 is set to 500 μm, even if the amount of crowning (Hc) of the heater holder 21 is set as high as 500 μm, the stress generated in the heater 22 can be reduced. It has been confirmed that there is no problem in the evaluation result of breaking of abnormal temperature rise even in a case where a recording material P having a grammage of 52 g/m$^2$ was used.

According to Configuration 2 of the present embodiment, the amount of warping (Hw) of the heater 22 is set to 500 μm. Then, even though the amount of crowning (Hc) of the where the amount of warping (Hw) of the heater 22 when no external force is received was set to 500 μm or greater.

As described above, according to the present embodiment, the heating unit is formed into a crown shape (warped shape) protruding toward the side having the heater element and the cover layer in a state where the heating unit does not receive deformation force, i.e., external force. Thus, it becomes possible to realize both suppression of occurrence of paper wrinkles and safety margin of the evaluation of breaking of electric power conduction even in a case where a recording material P having a low grammage, such as thin paper, is passed through.

Figure 7A:
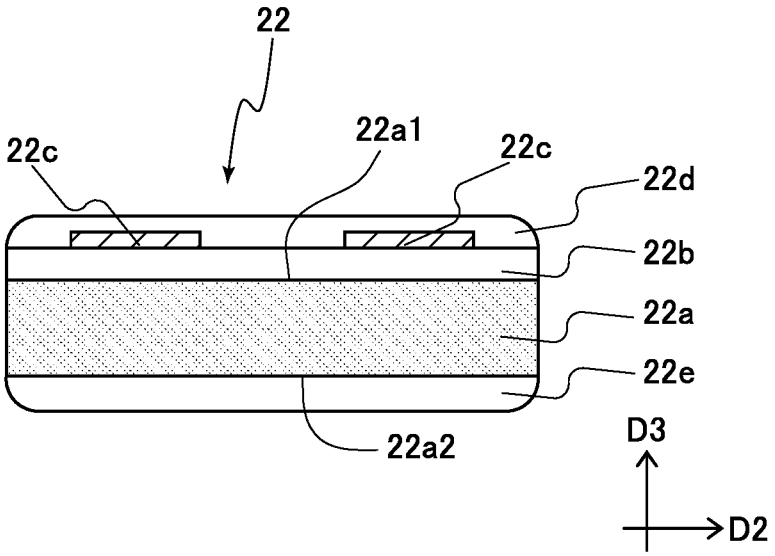
FIG. 7A is a cross-sectional view of a heater according to a second embodiment.
Figure 7B:
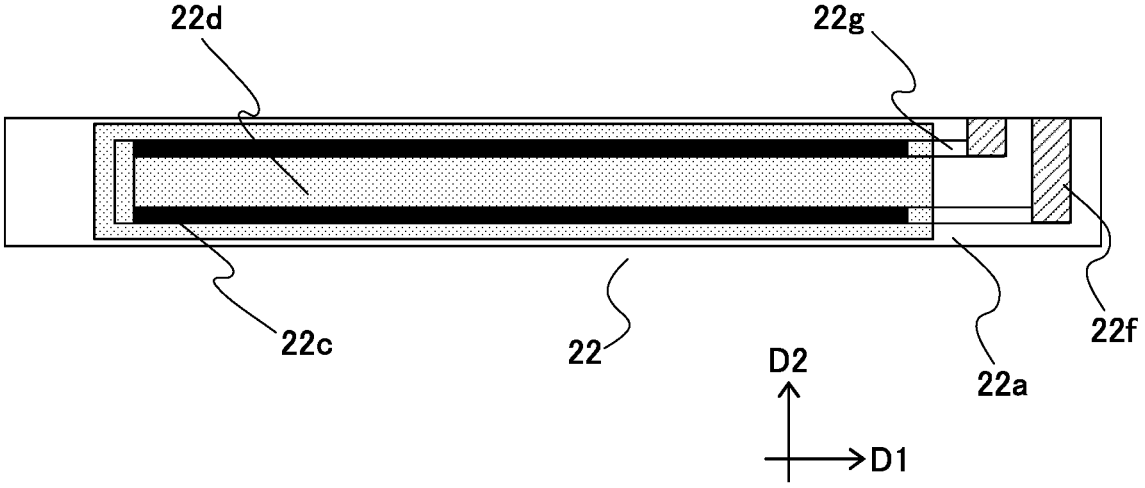
FIG. 7B is a top view of the heater according to the second embodiment.

According to the present embodiment, the insulating layer **22*b* and the cover layer 22*d* are provided only on the side of the substrate 22*a* having the heating element 22*c*, and the thickness of the substrate 22*a* and the thickness of the cover layer 22*d* are adjusted to control the amount of warping (Hw) of the heater 22, but the amount of warping (Hw) can also be controlled by other methods. As illustrated in FIGS. 7A and 7B, it is also possible to provide an insulating layer 22*e*, that is, second insulating layer in a case where the insulating layer 22*b* is referred to as the first insulating layer, on a side opposite to the side having the heating element 22*c*. In that case, by setting the insulating layer 22*e* thinner than the total thickness of the insulating layer 22*b* and the cover layer 22*d*, it becomes possible to acquire similar effects as the present embodiment by controlling the warping of the heater 22 to be in the same direction as the crowning surface of the heater holder 21**.

SECOND EMBODIMENT

A fixing unit and an image forming apparatus according to a second embodiment will be described. The present embodiment differs from the first embodiment in that the difference in nip widths of the fixing nip portion is realized by the amount of warping (Hw) of the heater 22 by increasing the flexural rigidity of the heater 22 and not depending on the crown shape of the heater holder 21. Other elements that are denoted with the same reference numbers as the first embodiment are assumed to have the same configuration and effects as the first embodiment.

In the present embodiment, the thickness of the substrate 22*a* was set to 1.5 mm so as to increase the flexural rigidity of the heater 22. Further, the only insulating layer was formed on the side having the heating element 22*c*, and the total thickness of the insulating layer 22*b* and the cover layer 22*d* were varied to create a heater 22 whose amount of warping (Hw) was set to three levels, which were 300 μm, 500 μm and 800 μm. As a comparative example, a configuration where the amount of warping (Hw) of heater is set to 0 mm was provided.

Table 2 shows a result of the evaluation of occurrence of paper wrinkles and the evaluation of breaking of abnormal temperature rise according to the configuration of the present embodiment and the configuration of the comparative example. The configuration of the comparative example adopted a heater 22 whose amount of warping (Hw) is set to 0 mm, similar to the first embodiment.

TABLE 2

| | | | | SECOND EMBODIMENT | | |
|---|---|---|---|---|---|---|
| | | | COMPARATIVE EXAMPLE | CONFIGU-RATION 1 | CONFIGU-RATION 2 | CONFIGU-RATION 3 |
| AMOUNT OF WARPING OF HEATER 22 (μm) | | | 0 | 300 | 500 | 800 |
| NIP WIDTH DIFFERENCE (mm) | | | 0.0 | 0.2 | 0.4 | 0.7 |
| CONVEYANCE SPEED DIFFERENCE OF RECORDING MATERIAL (mm/sec) | | | 0.0 | 0.8 | 1.9 | 3.2 |
| EVALUATION OF OCCURRENCE OF PAPER WRINKLES | PAPER GRAMMAGE (g/m^2) | 80 | GOOD | GOOD | GOOD | GOOD |
| | | 75 | GOOD | GOOD | GOOD | GOOD |
| | | 64 | POOR | GOOD | GOOD | GOOD |
| | | 52 | POOR | POOR | GOOD | GOOD |
| | | 42 | POOR | POOR | POOR | GOOD |
| EVALUATION OF BREAKING OF ABNORMAL TEMPERATURE RISE | | | GOOD | GOOD | GOOD | GOOD |

Regarding the configuration of the comparative example, since the amount of warping (Hw) of the heater 22 is 0 mm, there was no difference between nip widths at the center portion in the longitudinal direction and at end portions in the longitudinal direction, and there was no difference in conveyance speeds of the recording material P, so that paper wrinkles occurred in the recording material P having a grammage of 64 g/m$^2$ or less. In the configuration of the present embodiment, as the amount of warping (Hw) of the heater 22 increases, the difference in nip widths between the center portion in the longitudinal direction and the end portions in the longitudinal direction increases, so that it becomes possible to realize a difference in conveyance speeds of the recording material P It has been confirmed that paper wrinkles did not occur to the recording material P having a grammage of 64 g/m$^2$ or more in Configuration 1 where the amount of warping (Hw) of the heater 22 is 300 μm, to the recording material P having a grammage of 52 g/m$^2$ or more in Configuration 2 where the amount of warping (Hw) of the heater 22 is 500 μm, and to the recording material P having a grammage of 42 g/m$^2$ or more in Configuration 3 where the amount of warping (Hw) of the heater 22 is 800 μm. Further according to the present embodiment, the heater 22 will not deform by pressure, so that it has been confirmed that there is a margin in the evaluation of breaking of abnormal temperature rise in all Configurations 1 to 3.

In the present embodiment, the insulating layer 22*b* is formed only on the surface 22*a*1 (i.e., first surface) of the substrate 22*a* on the side (i.e., first side) having the heating element 22*c*, but the present disclosure is not limited thereto, and the insulating layer may be formed on both surfaces 22*a*1 and 22*a*2, that is, first and second surfaces, of the substrate 22*a*. In this case, similar effects as providing an amount of warping (Hw) of the heater 22 can be achieved by increasing the thickness of the insulating layer 22*b* on the surface 22*a*1 on the side having the heating element 22*c* than the thickness of the insulating layer on the surface 22*a*2 on the side not having the heating element 22*c*.

OTHER EXAMPLES

The respective embodiments described above have been illustrated based on a monochrome image forming apparatus. However, the present technique is applicable to a tandem-type color image forming apparatus using a recording material conveyor belt, a four-cycle intermediate-transfer-type color image forming apparatus, or a tandem intermediate-transfer-type color image forming apparatus. The present technique is also applicable to a fixing unit used in a similar configuration, such as a color image forming apparatus using a recording material conveyor belt in the intermediate transfer system, or an image forming apparatus using four or more kinds of toner.

In the first embodiment, it has been described that a preferable condition for realizing a most preferable configuration is for the difference between the amount of warping (Hw) of the heater 22 and the amount of crowning (Hc) of the heater holder 21 to be less than 500 μm. However, the margin of the evaluation of breaking of abnormal temperature rise varies according to the configuration of the fixing unit, including the resistance value of the heater 22, or power used for evaluating the breaking of abnormal temperature rise, and the configuration of the electric power conduction breaking element 40. Similar effects may be achieved even if the difference between the amount of warping (Hw) of the heater 22 and the amount of crowning (Hc) of the heater holder 21 is 500 μm or more, as long as the heating unit is formed in a crowned warped shaped toward the side having the heating element and the cover layer in a state where no deformation force, i.e., external force, is applied to the heating unit.

It has also been described according to the first embodiment that the condition of the amount of crowning (Hc) of the heater holder 21 should preferably be set to 300 μm or more. However, the tendency of occurrence of paper wrinkles differs according to the configuration for conveying the recording material of the image forming apparatus. Even if the amount of crowning (Hc) of the heater holder 21 is less than 300 μm, similar effects can be achieved and the present technique can be applied as long as the heating unit is formed in a crowned warped shape toward the side having the heating element and the cover layer in a state where no deformation force is applied to the heating unit.

A method of forming a layer of material having a different linear expansion coefficient as the substrate 22*a* to only one side of the substrate 22*a*, or of providing a difference in the thickness of the layers formed on either sides, has been illustrated as an example of the method for warping the heater 22 in a state where no external force is applied thereto, but other methods can also be adopted. For example, a plate subjected to bending in advance may be utilized as the substrate 22*a*.

According further to the fixing unit of the respective embodiments described above, the heater 22 is directly in contact with the inner surface of the film, but it is also possible to arrange a sheet having a high thermal conductivity, such as a sheet formed of a material such as ferrous alloy or aluminum, between the heater and the inner surface of the film. In other words, a nip forming unit with a configuration where the heater heats the film through a sheet-type member can be adopted.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026804, filed on Feb. 20, 2020, which is hereby incorporated by reference herein in its entirety.

What is claimed is:

1. A heater comprising:

a substrate formed of metal into a plate shape in which a length in a longitudinal direction thereof is greater than a length in a short direction thereof when viewed in a thickness direction thereof;

a first insulating layer formed of insulating material on a first surface of the substrate on a first side in the thickness direction;

a second insulating layer formed of insulating material on a second surface of the substrate on a second side opposite to the first side in the thickness direction;

a heating element arranged on the insulating layer and configured to generate heat by flowing electric current therethrough; and a cover layer arranged to cover the heating element, wherein the heater is a warped shape when receiving no external force, such that a center portion of the heater in the longitudinal direction protrudes to the first side in the thickness direction compared to both end portions of the heater in the longitudinal direction, and wherein a total thickness of the first insulating layer and the cover layer is greater than a thickness of the second insulating layer.

2. The heater according to claim 1, wherein an amount of warping of the heater is 500 μm or greater.

3. The heater according to claim 1, wherein each of the first insulating layer and the cover layer is formed of a material having a smaller linear expansion coefficient than that of the substrate.

4. A fixing unit comprising:

a film with a tubular shape;

a nip forming unit comprising the heater according to claim 1 and a holding member configured to hold the heater, the nip forming unit being arranged inside the film; and a pressing member arranged to oppose to the nip forming unit with the film interposed therebetween and form a nip portion with the film, wherein the fixing unit is configured to fix an image that has been formed on a recording material to the recording material while nipping and conveying the recording material at the nip portion.

5. The fixing unit according to claim 4, wherein the holding member comprises a bearing surface configured to bear the heater in a pressing direction of the pressing member, a center portion of the bearing surface in the longitudinal direction protruding toward the pressing member compared to both end portions of the bearing surface in the longitudinal direction.

6. The fixing unit according to claim 5, wherein a difference between an amount of protrusion of the bearing surface and an amount of warping of the heater when receiving no external force is less than 500 μm.

7. The fixing unit according to claim 4, wherein a conveyance speed of a recording material at a center portion of the nip portion in the longitudinal direction is slower than the conveyance speed of the recording material at both end portions of the nip portion in the longitudinal direction.

8. The fixing unit according to claim 4, wherein the cover layer is configured to be in sliding contact with an inner surface of the film.

9. An image forming apparatus comprising:

an image bearing member configured to rotate;

a transfer unit configured to transfer a toner image borne on a surface of the image bearing member to a recording material; and the fixing unit according to claim 4 configured to fix the toner image having been transferred to the recording material by the transfer unit to the recording material.

10. A fixing unit comprising:

a film with a tubular shape;

a nip forming unit comprising a heater and a holding member configured to hold the heater, the nip forming unit being arranged inside the film; and a pressing member arranged to oppose to the nip forming unit with the film interposed therebetween and form a nip portion with the film, wherein the fixing unit is configured to fix an image that has been formed on a recording material to the recording material while nipping and conveying the recording material at the nip portion, wherein the heater comprises:

a substrate formed of metal into a plate shape in which a length in a longitudinal direction thereof is greater than a length in a short direction thereof when viewed in a thickness direction thereof;

an insulating layer formed of insulating material on a first surface of the substrate on a first side in the thickness direction;

a heating element arranged on the insulating layer and configured to generate heat by flowing electric current therethrough; and a cover layer arranged to cover the heating element, wherein the heater is a warped shape when receiving no external force, such that a center portion of the heater in the longitudinal direction protrudes to the first side in the thickness direction compared to both end portions of the heater in the longitudinal direction, wherein the holding member comprises a bearing surface configured to bear the heater in a pressing direction of the pressing member, a center portion of the bearing surface in the longitudinal direction protruding toward the pressing member compared to both end portions of the bearing surface in the longitudinal direction, and wherein a difference between an amount of protrusion of the bearing surface and an amount of warping of the heater when receiving no external force is less than 500 μm.

11. The fixing unit according to claim 10, wherein, when viewed from a second side opposite to the first side in the thickness direction, a second surface of the substrate opposite to the first surface is exposed.

12. The fixing unit heater according to claim 10, wherein the insulating layer is a first insulating layer, wherein the heater further includes a second insulating layer formed of insulating material on a second surface of the substrate on a second side opposite to the first side in the thickness direction, and wherein a total thickness of the first insulating layer and the cover layer is greater than a thickness of the second insulating layer.

13. The fixing unit according to claim 10, wherein a conveyance speed of a recording material at a center portion of the nip portion in the longitudinal direction is slower than the conveyance speed of the recording material at both end portions of the nip portion in the longitudinal direction.

14. The fixing unit according to claim 10, wherein the cover layer is configured to be in sliding contact with an inner surface of the film.

15. An image forming apparatus comprising:

an image bearing member configured to rotate;

a transfer unit configured to transfer a toner image borne on a surface of the image bearing member to a recording material; and the fixing unit according to claim 10 configured to fix the toner image having been transferred to the recording material by the transfer unit to the recording material.

* * * * *